US007156428B2

(12) United States Patent
Smith

(10) Patent No.: US 7,156,428 B2
(45) **Date of Patent: *Jan. 2, 2007**

(54) SINGLE SWITCH SPRINGLESS OVEN DOOR LATCH ASSEMBLY

(75) Inventor: Donald E. Smith, Smithville, TN (US)

(73) Assignee: France/Scott Fetzer Company, Fairview, TN (US)

( * ) Notice: Subject to any disclaimer, the term of this patent is extended or adjusted under 35 U.S.C. 154(b) by 279 days.

This patent is subject to a terminal disclaimer.

(21) Appl. No.: 10/901,754

(22) Filed: Jul. 29, 2004

(65) Prior Publication Data

US 2006/0001274 A1 Jan. 5, 2006

Related U.S. Application Data

(63) Continuation-in-part of application No. 10/884,162, filed on Jul. 2, 2004, now Pat. No. 7,066,503.

(51) Int. Cl.
*F05C 3/06* (2006.01)

(52) U.S. Cl. ..... 292/201; 292/109

(58) Field of Classification Search ..... 292/201, 292/DIG. 69, 109; 126/197
See application file for complete search history.

(56) References Cited

U.S. PATENT DOCUMENTS

| | | | | |
|---|---|---|---|---|
| 3,438,666 | A | 4/1969 | Erickson | |
| 4,082,078 | A * | 4/1978 | Thuleen et al. | 126/197 |
| 4,374,320 | A * | 2/1983 | Barnett | 219/413 |
| 4,927,996 | A * | 5/1990 | Genbauffe et al. | 219/413 |
| 5,029,910 | A | 7/1991 | Genbauffe et al. | |
| 5,493,099 | A | 2/1996 | McWilliams, III | |
| 6,137,067 | A | 10/2000 | Helms et al. | |
| 6,302,098 | B1 | 10/2001 | Smith | |
| 6,315,336 | B1 | 11/2001 | Swartzell | |
| 6,698,418 | B1 | 3/2004 | Ramsey et al. | |

* cited by examiner

*Primary Examiner*—Gary Estremsky
(74) *Attorney, Agent, or Firm*—Wood, Herron & Evans, LLP

(57) ABSTRACT

A single switch springless motorized door latch assembly for locking an oven door in a locked and sealed position for purposes of cleaning the oven. The switch is a single pole single throw switch. A motor and cam cause a latch member to move between three different positions. In one position the latch member prevents the oven door from opening. From this position, the latch member is pulled inwardly so the oven door is in a locked and sealed position. In its locked and sealed position the door may not be opened.

19 Claims, 6 Drawing Sheets

SINGLE SWITCH SPRINGLESS OVEN DOOR LATCH ASSEMBLY

CROSS-REFERENCE TO RELATED APPLICATIONS

This application is a continuation-in-part of U.S. patent application Ser. No. 10/884,162 entitled "Springless Oven Door Latch Assembly" filed Jul. 2, 2004, now U.S. Pat. No. 7,066,503, which is fully incorporated herein.

FIELD OF THE INVENTION

This application relates to a motorized oven door latch assembly for locking an oven door in a closed position when the oven is in a self-cleaning mode.

BACKGROUND OF THE INVENTION

Self-cleaning ovens which are incorporated into self-standing ranges are well known. Such ovens conventionally have an oven door which is hingedly secured to a range body. The oven door may be opened to gain access to an oven cavity. The oven door may also be closed to close the opening for cooking objects placed in the cavity or cleaning the cavity. One or more heating elements reside in the oven cavity for cooking purposes.

Motorized latches which are used to lock oven doors in a closed position so that the oven cavity may be self cleaned are well known. Assignee's U.S. Pat. Nos. 6,302,098 and 6,698,418 each disclose a motorized oven door latch assembly for locking an oven door in a locked and sealed position for purposes of cleaning the oven. Such oven door latches are activated by a rotary motor located remotely from the latch member above the oven cavity. Activation of the motor causes a rod to translate which causes a latch member secured to the front of the rod to engage the oven door so that the oven door may not be opened. After the cleaning has occurred, the motor is reactivated, causing the latch member at the front of the rod to disengage the oven door so that the oven door may be opened.

Each of these motorized oven door latch assemblies utilizes a spring mechanism to bias the latch member into engagement with the oven door. The spring is typically secured at one end to a mounting plate secured to the range and is secured at the other end to the movable latch member. With repeated use, the spring may wear down and may eventually fail to function properly if subject to enough use.

Motorized range lock assemblies such as the one disclosed in U.S. Pat. No. 6,315,336 have been manufactured and sold without such a spring. One disadvantage with motorized oven door latch assemblies having no spring is that the latch member moves between two positions rather than three. In other words, existing range lock assemblies without springs do not provide what is known in the industry as a "pull in" feature. The pull in feature enables the oven door to move to a locked and sealed position when the latch member is in its third position. When the latch member is in this third pulled in position, the motorized range lock assembly causes the oven door to exert pressure on a gasket sandwiched between the front wall of the range and the oven door.

Many motorized range lock assemblies such as the one disclosed in U.S. Pat. No. 6,315,336 have been manufactured and sold with two single pole single throw switches. Other motorized oven door latch assemblies such as those disclosed in Assignee's U.S. Pat. Nos. 6,302,098 and 6,698,418 each disclose a motorized oven door latch assembly having only one single pole double throw switch. The cost of a single pole double throw switch is greater than the cost of a single pole single throw switch. In order to reduce manufacturing cost of a motorized oven door latch assembly it would be beneficial to incorporate only one single pole single throw switch into the assembly. Therefore, a need exists for a motorized oven door latch assembly which incorporates only one single pole single throw switch.

SUMMARY OF THE INVENTION

The invention which accomplishes these objectives comprises a motorized door latch assembly for locking an oven door in a closed and sealed position so as to close an oven cavity for purposes of cleaning the oven cavity. The oven door is hingedly mounted on a range body and moveable between an open position, a closed position and a closed and sealed position.

The door latch assembly comprises a mounting plate supported by the range body above the oven cavity and extending generally horizontally. The mounting plate has a guide therethrough proximate the front of the mounting plate. The mounting plate also has a pair of mounting tabs extending upwardly from the body of the mounting plate. The mounting tabs have holes therein to receive fasteners for purposes of mounting the motor above the mounting plate in a location in which the motor does not overheat.

Fixedly secured to the mounting tabs of the mounting plate is a driver such as a motor assembly including a motor and a drive spline. The motor may be fixedly or removably secured to the mounting tabs of the mounting plate or any other portion of the mounting plate at any desired location. The motor rotates a drive spline which extends downwardly from the motor and is engaged with a spline hole formed in a cam, operatively associated with the motor. Thus rotation of the drive spline by the motor assembly causes the cam to rotate.

The cam is sandwiched between the latch member and the motor. The underside of the cam has a contact portion which contacts flanges of the latch member to move the latch member to its desired position upon rotation of the cam. The cam has features varying over the extent of the cam for purposes of moving a switch between a first and second state, i.e. activating the switch.

A latch plate or latch member, having a hook at one end for engaging the oven door, is moved between three positions by rotation of the cam. The latch member is movable between a first position in which the oven door may be opened; a second position in which the oven door may not be opened and a third position in which the oven door is in a locked and sealed position.

The latch member has a pair of spaced parallel upwardly extending flanges at the rear end of the latch member. Rotation of the cam causes a portion of the cam to engage or contact the flanges of the latch member to move the latch member between the three positions.

One of the latch member and mounting plate has a pin and the other of the latch member and mounting plate has a guide in which the pin moves. The size and configuration of the guide and location of the pin restrict the movement of the latch member so as to move the latch member between the three desired positions.

A single pole single throw switch is secured to the mounting plate and actuated by the cam. The switch is movable between a first state and a second state, the switch being in the first state when the cam actuates the switch and the switch being in the second state when the cam does not actuate the switch. The switch is coupled to a controller which controls operation of the motor.

In operation, rotation of the cam by activation of the motor causes the latch member to move between the three positions. In the first position, the latch member is located such that the oven door may be opened and closed. Upon further rotation of the cam, the latch member moves to a second position in which the hook of the latch member engages the oven door to prevent the oven door from being opened and closed. In the third position, the latch member is pulled inwardly by the cam, pulling the oven door into a locked and sealed position.

DETAILED DESCRIPTION OF THE DRAWINGS

Figure 1:
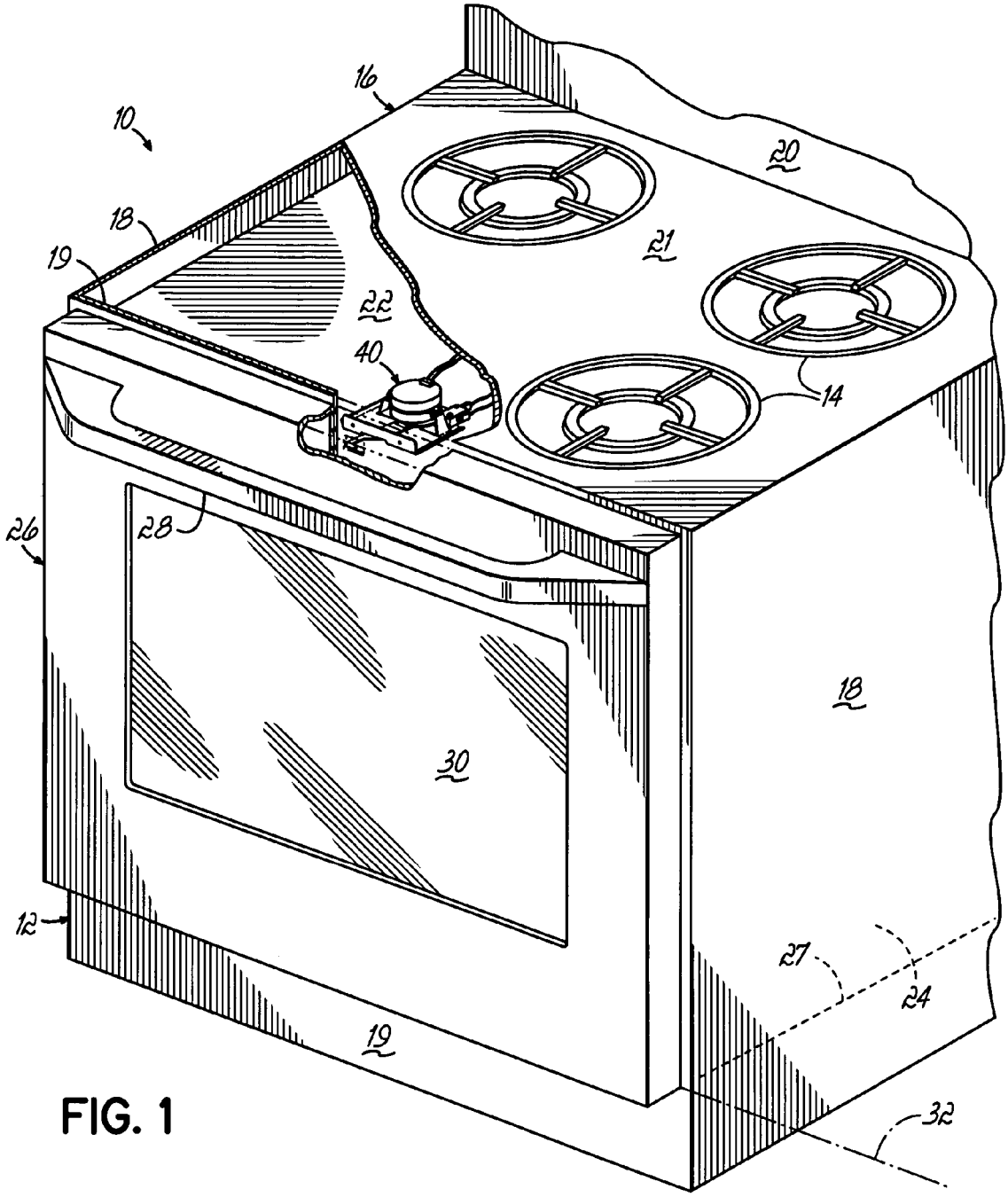
FIG. 1 is a perspective view of a self-standing range, with a portion cut away, having the motorized oven door latch assembly of the present invention.

Referring to the drawings, and particularly to FIG. 1, there is illustrated a self-standing range 10 including a pyrolytic self-cleaning oven 12 on top of which are a plurality of burners 14 as is conventional. The range 10 comprises a range body 16 having a pair of side walls 18, a front wall 19, a back wall 20 (see FIG. 1) and a top 21. Spaced a fixed distance below the top 21 of the range body 16 is an oven top wall 22. An oven cavity 24 inside which resides one or more heating elements (not shown) is defined by the oven top wall 22, side walls 18 of the range body, a cavity back wall (not shown) and a bottom 27. An oven door 26 having a handle 28 and a window 30 is hingedly mounted to the front wall 19 of the range body so that a user pulling on the handle 28 will cause the oven door 26 to hingedly open about an horizontal axis 32 in order to move the door 26 between a closed position as shown in FIG. 1 and an open position.

As best illustrated in FIGS. 4–8, the oven door 26 has a thickness T defined between a back wall 34 and a front wall 36 between which is insulation 38. The back wall 34 has an opening 39 formed therein.

Illustrated within range 10 above top wall 22 and below top 21 of the range body 16, is a motorized door latch assembly 40 mounted to the range body 16 and/or the range walls 21 and 22, and positioned to latch door 26 in a closed and sealed position by the action of the front hook 90 of a latch member 42. Further detail on the structure of motorized door latch assembly 40 and the interaction of latch member 42 with oven door 26 is provided below.

Figure 2:
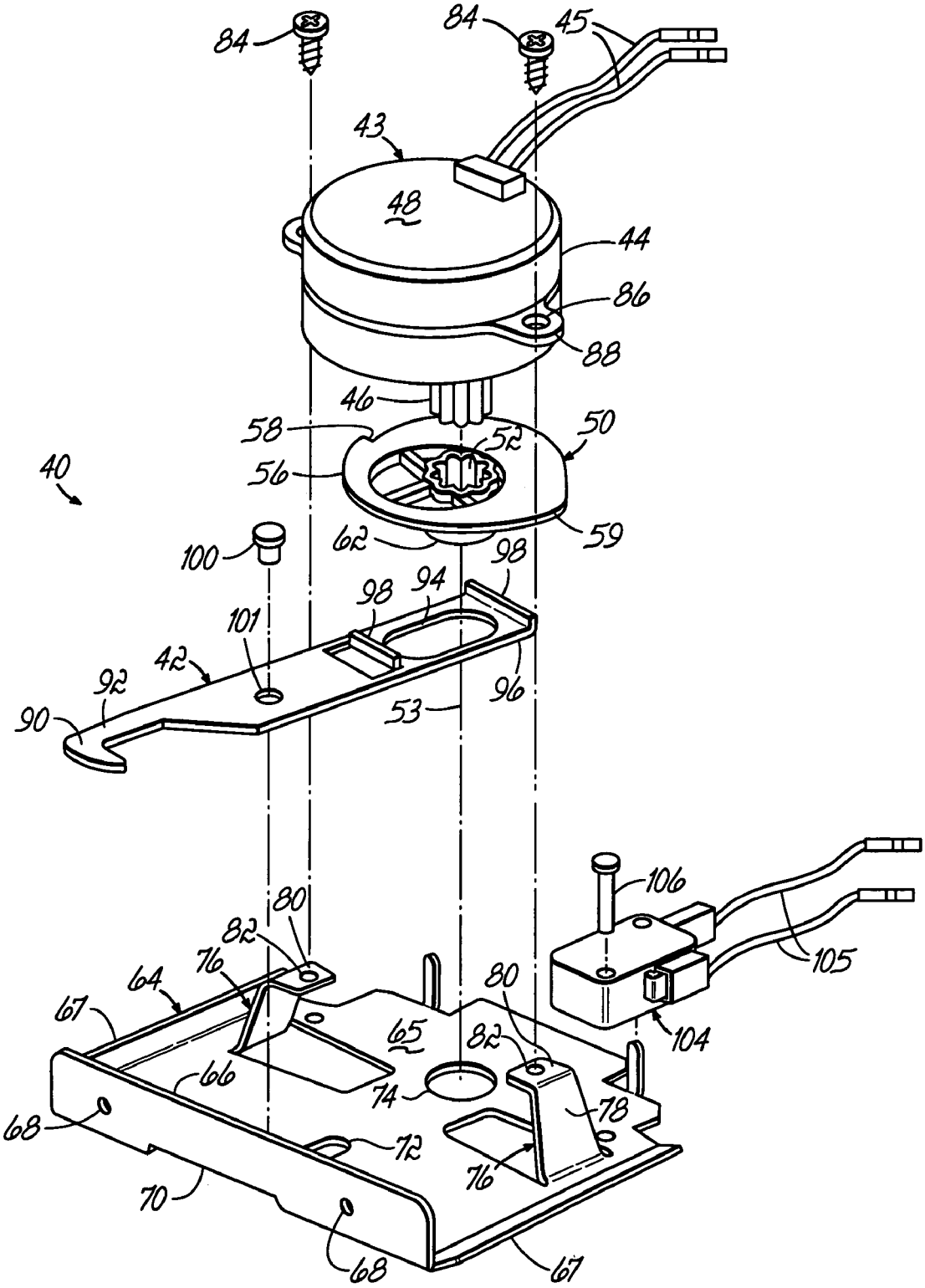
FIG. 2 is an disassembled perspective view of the motorized oven door latch assembly shown in FIG. 1.

As best illustrated in FIG. 2, the door latch assembly 40 functions to lock the oven door 26 in a closed and sealed position so that the oven door 26 may not be opened e.g. when the oven is in a self-cleaning mode. The motorized door latch assembly 40 comprises multiple components which work together to move a latch member 42, best illustrated in FIG. 2, between three different positions so that the oven door 26 may be opened when the latch member 42 is in a first position and the oven door 26 may not be opened when the latch member 42 is in either its second or third position.

The door latch assembly 40 comprises a motor assembly 43 including a motor 44 activated by power lines 45. One type of motor which has proven satisfactory is manufactured by assignee and operates at 120 volts AC; 60 Hz having a speed of 2 rpm. The motor assembly 43 further includes a drive spline 46 extending downwardly from a motor housing 48.

A cam 50 is operatively coupled to the motor assembly 43. The cam 50 has a spline hole 52 configured and adapted to receive and retain the drive spline 46 of the motor 44 such that rotation of the drive spline 46 of the motor 44 causes the cam 50 to rotate about a vertical axis 53. See FIG. 2.

Figure 9:
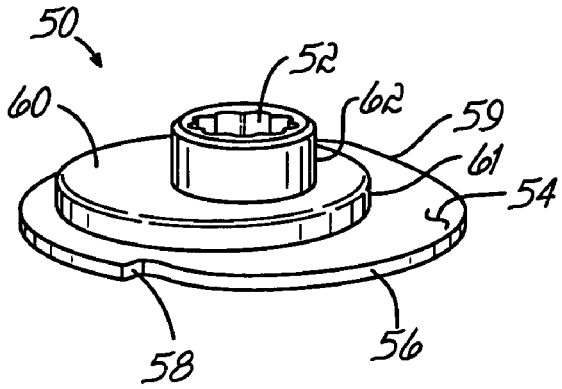
FIG. 9 is a bottom perspective view of the cam of the motorized oven door latch assembly shown in FIG. 1.

As seen in FIG. 9, the cam 50 has an upper portion 54 having a peripheral edge 56. An indent 58 is formed in the upper portion 54 and extends inwardly from the peripheral edge 56 of the upper portion 54 to activate the switch 104 in a manner described below. Diametrically opposed to the indent 58 is a ramp portion 59 formed in the peripheral edge 56 of the upper portion 54 of the cam 50.

Below the upper portion 54 of the cam 50 is a contact portion 60 having a peripheral edge 61. The peripheral edge 61 contacts the flanges 98 of the latch member 42 in a manner described below. See FIG. 2. Below the contact portion 60 of the cam 50 is a spline portion 62. The spline hole 52 extends through the entire cam 50 including the spline portion 62, the contact portion 60 and the upper portion 54.

Figure 3:
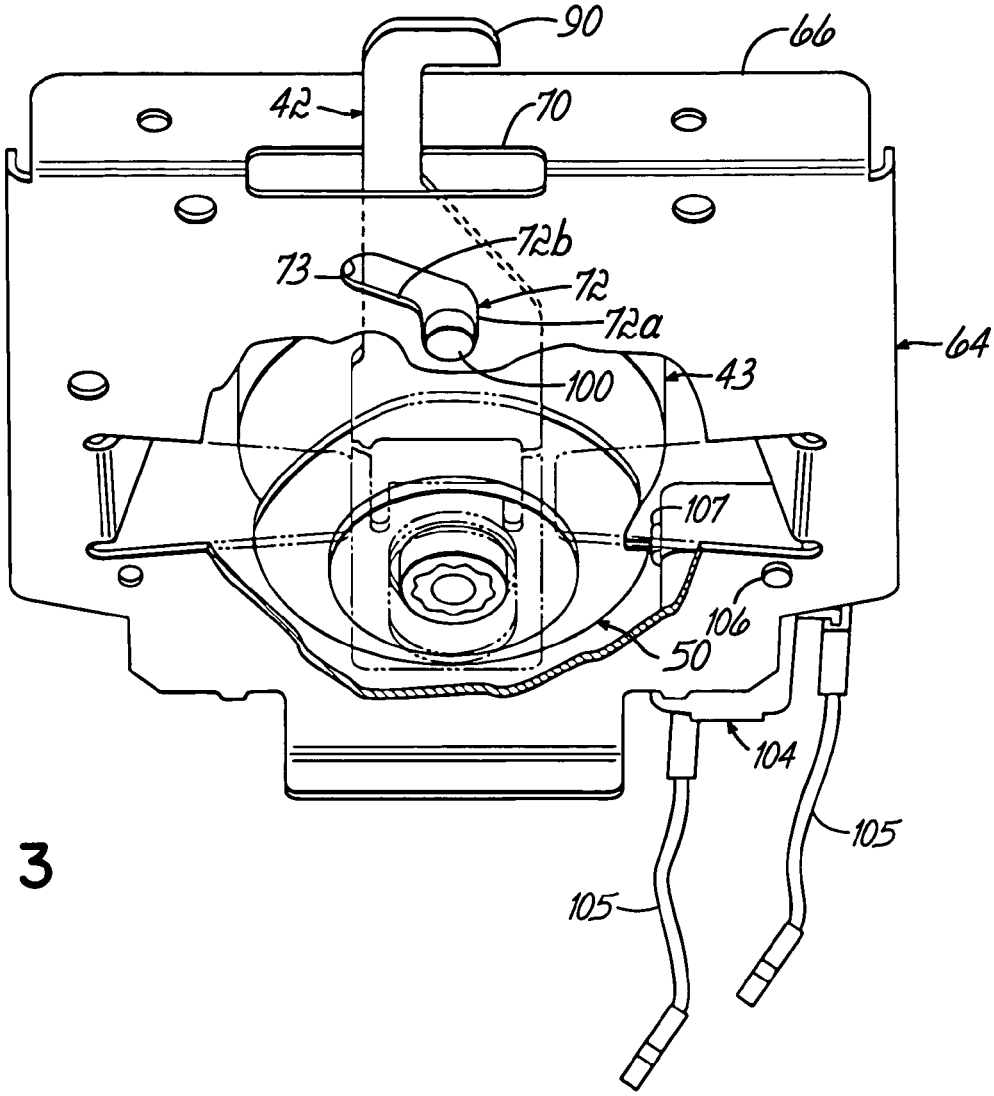
FIG. 3 is a bottom perspective view of the motorized oven door latch assembly of the present invention.

Referring again to FIG. 2, a generally rectangular mounting plate 64 is secured to range 10 in any desired manner. The mounting plate 64 has a generally planar body 65, a front lip 66 extending upwardly from the front of the body 65 along with two side lips 67 extending upwardly from the sides of the body 65. The front lip 66 preferably is secured the front wall 19 of the range 10 with fasteners (not shown) extending through holes 68 in the front lip 66 of the mounting plate 64. Preferably, the mounting plate 64 is located below the top 21 of the range and above the top wall 22 of the oven cavity. As best seen in FIG. 3, the front lip 66 of the mounting plate 64 has a generally rectangular opening 70 through which the latch member 42 passes. Although the drawings illustrate one configuration of mounting plate 64 located in a particular orientation, the mounting plate 64 may be secured to the range in other locations or be other configurations without departing from the spirit of the invention.

As best illustrated in FIG. 3, an opening or guide 72 is located through the body 65 of the mounting plate 64. The guide 72 is an opening of a particular configuration illustrated in detail in FIG. 3 comprising a generally linear shaped rear portion 72*a* and a generally linear shaped front portion 72*b* having a stopping surface 73. The front and rear portions 72*b*, 72*a* of the guide 72 form an obtuse angle therebetween giving the guide 72 a generally L-shaped configuration. The size and configuration of the guide 72 limits the movement of the latch member 42 in a manner described in more detail below.

As illustrated in FIG. 2, the body 65 of the mounting plate 64 also has a circular hole 74 therethrough which is sized and adapted to receive the spline portion 62 of the cam 50.

The mounting plate 64 also has a pair of mounting tabs 76 integrally formed from the body 65 of the mounting plate 64 and extending upwardly from the body 65 of the mounting plate 64. Each of the mounting tabs 76 has a generally vertical first portion 78 and a generally horizontal second portion 80 having a threaded hole 82 therethrough adapted to receive a fastener 84 passing through holes 86 in flanges 88 in the motor housing 48. As seen in FIG. 2, the mounting tabs 76 enable the motor 44 to be mounted above the body 65 of the mounting plate 64 in a location in which the cam 50 may be sandwiched between the latch member 42 and the motor housing 48. Furthermore, the mounting tabs 76 enable the motor 44 to be mounted above the oven top wall so the motor 44 does not overheat.

Another component of the motorized door latch assembly 40 is the latch member 42 best illustrated in FIG. 2. The latch member 42 has a hook 90 located at a front end 92 and an oval shaped opening 94 formed through the latch member 42 proximate a rear or back end 96 of the latch member 42. Between the front and back ends 92, 96 of the latch member 42 the oval shaped opening 94 of the latch member 42 is adapted to receive the spline portion 62 of the cam 50.

As best illustrated in FIG. 2, a pair of spaced, parallel upwardly extending flanges 98 at the rear end 96 of the latch member 42 are located to contact the peripheral edge 61 of the contact portion 60 of the cam 50 as the cam 50 rotates.

Referring to FIG. 2, a pin 100 is secured to the latch member 42 in hole 101 of the latch member 42 and extends downwardly therefrom in a fixed location. The pin 100 remains inside the guide 72 formed in the body 65 of the mounting plate 64 as the latch member 42 moves between positions. Alternatively, the pin 100 may be secured to the mounting plate 64 and the guide formed in the latch member 42 to restrict movement of the latch member 42 as the latch member 42 moves between positions.

Figure 4:
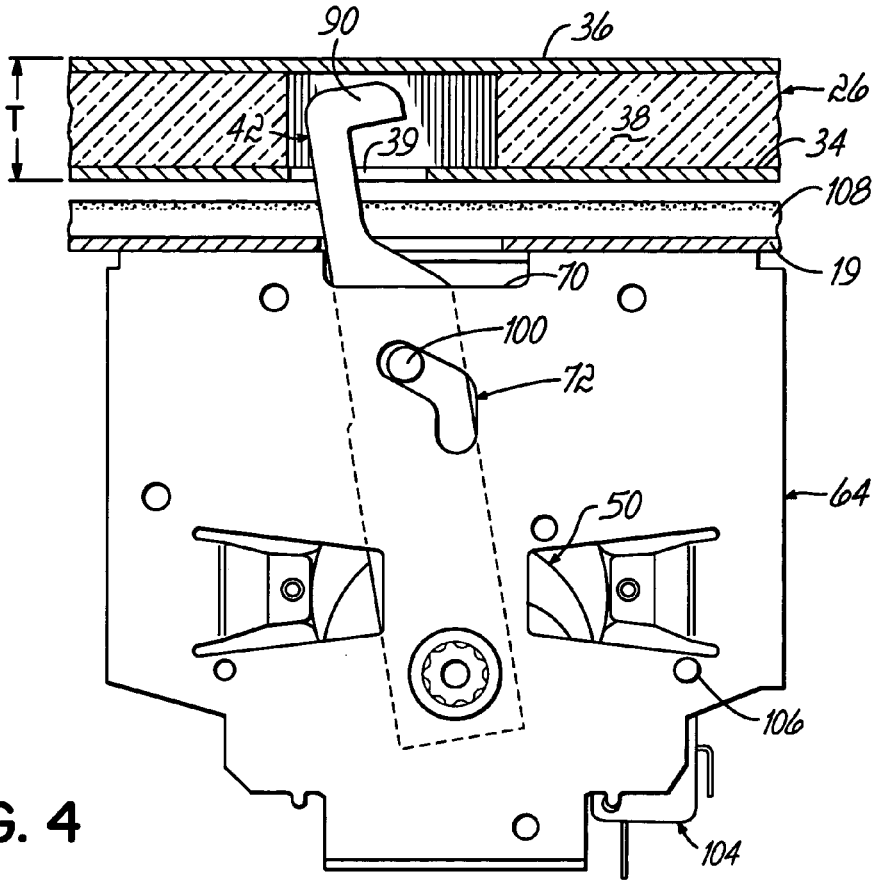
FIG. 4 is a bottom view of the motorized oven door latch assembly illustrating the latch member in a first position in which the oven door may be opened.
Figure 5:
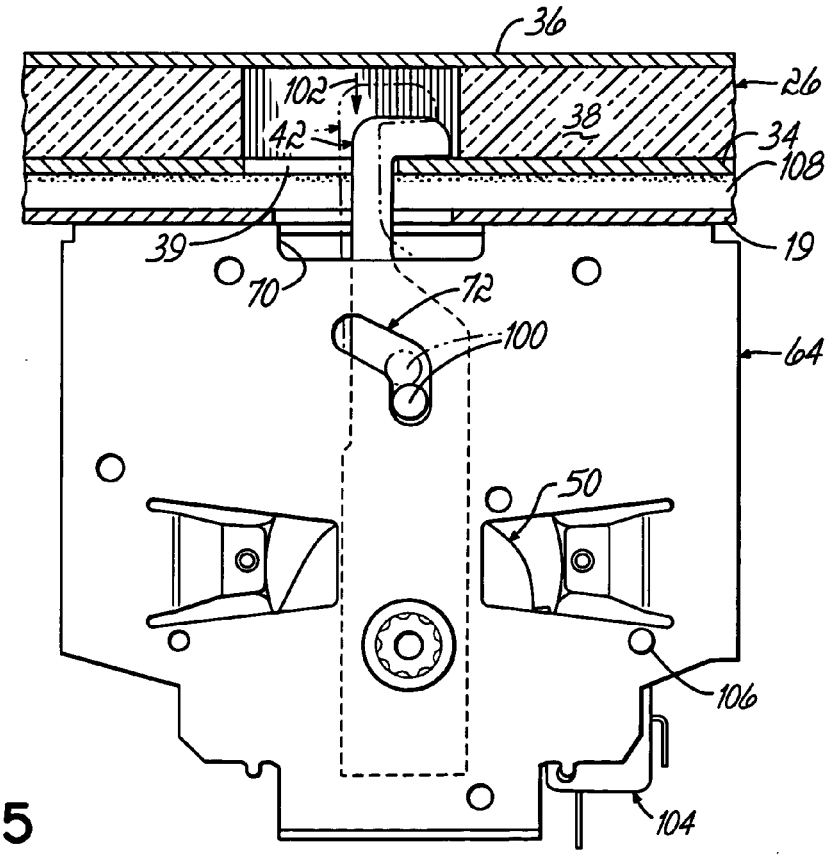
FIG. 5 is a bottom view of the motorized oven door latch assembly illustrating the latch member in second and third positions in which the oven door may not be opened.
Figure 6:
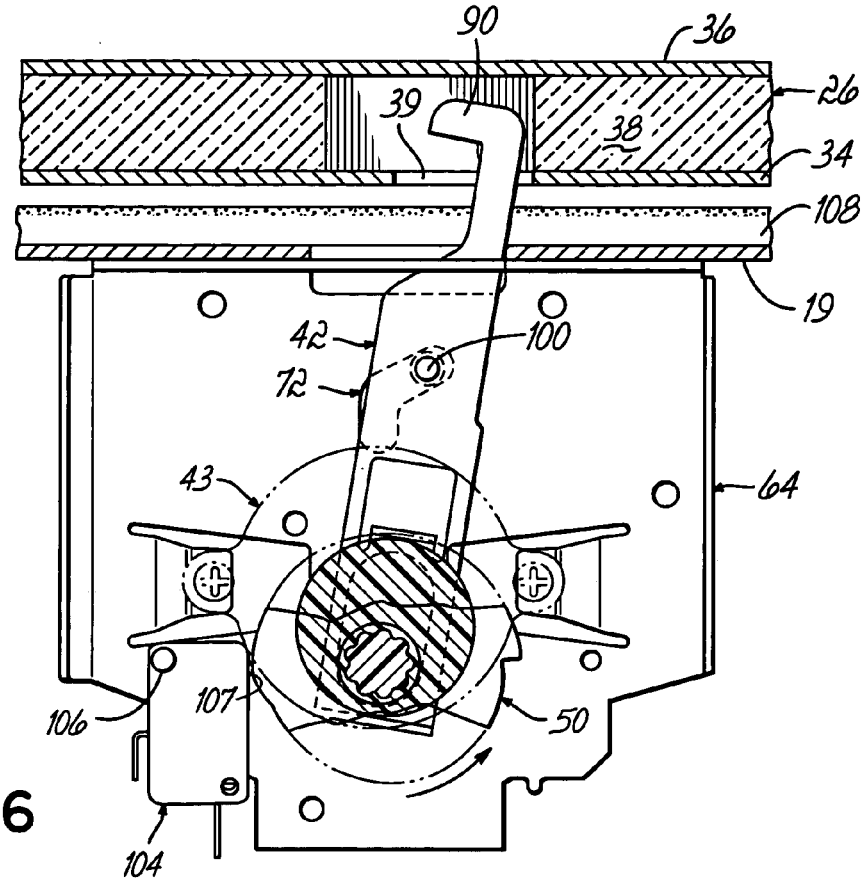
FIG. 6 is a top view of the motorized oven door latch assembly illustrating the latch member in a first position in which the oven door may be opened.
Figure 7:
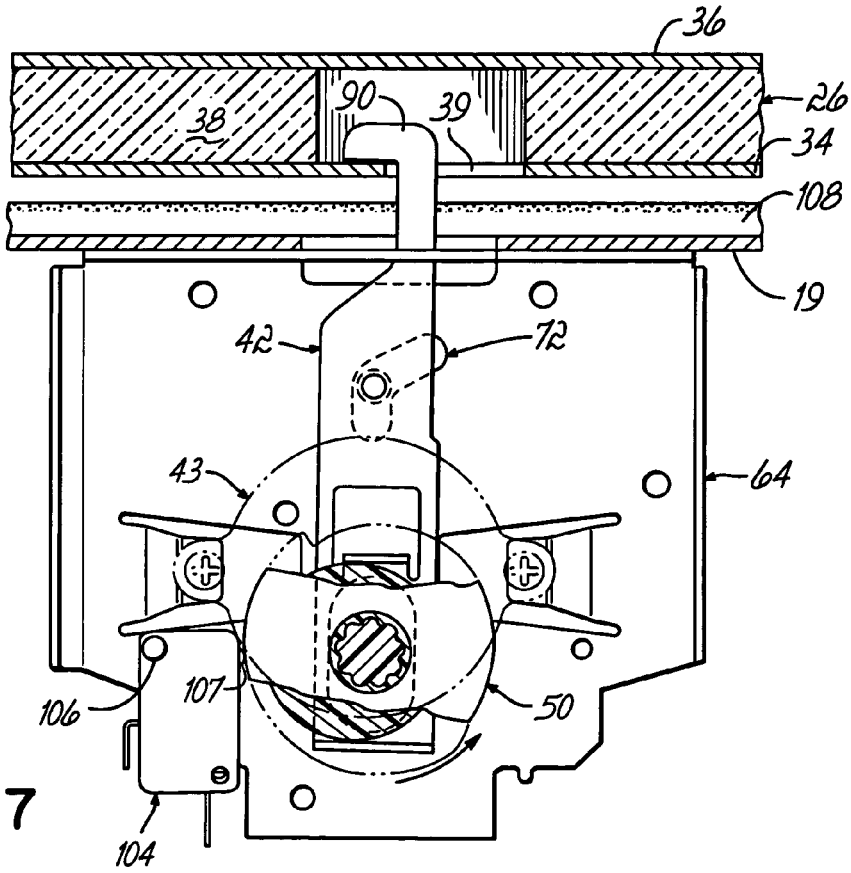
FIG. 7 is a top view of the motorized oven door latch assembly illustrating the latch member in a second position in which the oven door may not be opened.
Figure 8:
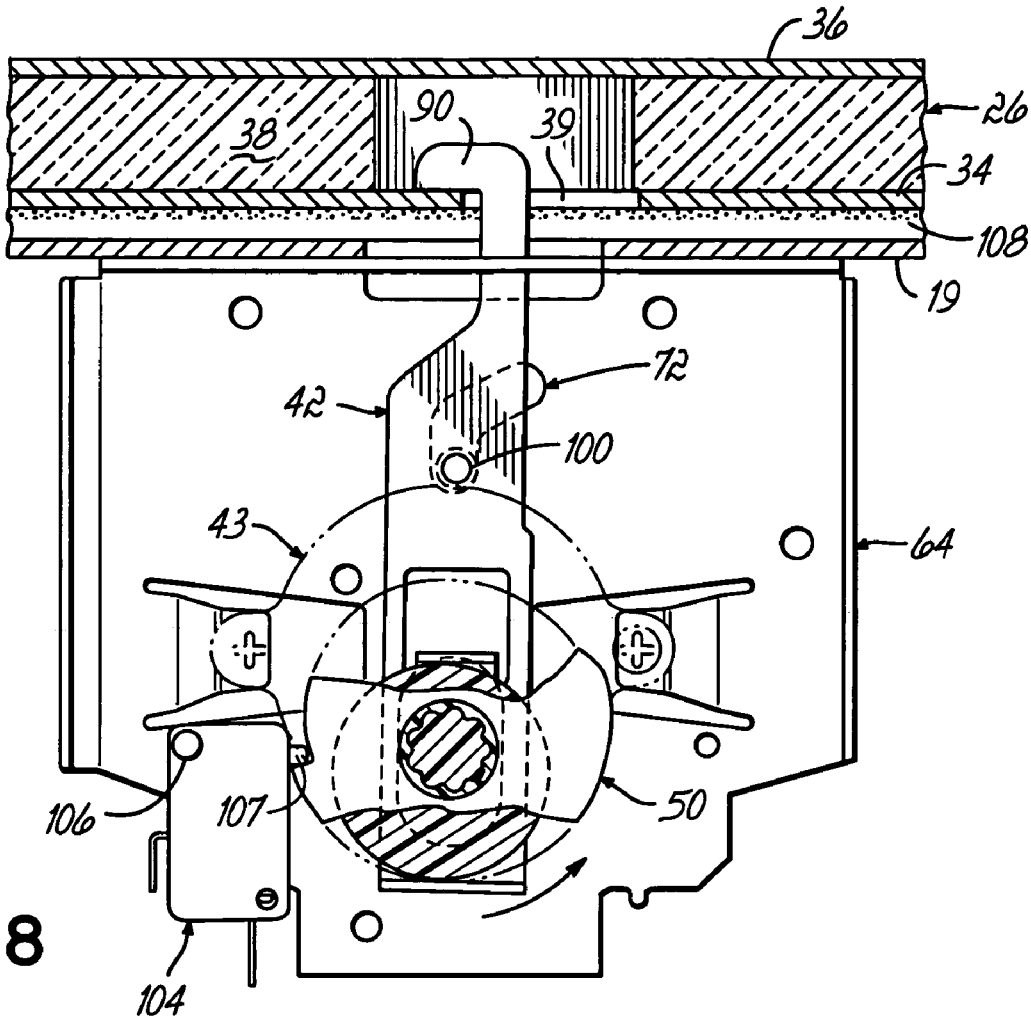
FIG. 8 is a top view of the motorized oven door latch assembly illustrating the latch member in a third position in which the oven door is in a locked and sealed position.

As best illustrated in FIGS. 4–8, the latch member 42 is movable between three positions: a first position illustrated in FIGS. 4 and 6, a second position illustrated in FIG. 7 and in dashed lines in FIG. 5 and a third position illustrated in FIGS. 5 and 8 (in which the door is locked and sealed). In the first position, the hook 90 of the latch member 42 is aligned with and may pass through an opening 39 in the back wall 34 of the oven door 26 (see FIGS. 4 and 6). With the latch member 42 in this first position, the oven door 26 may be freely opened and closed, the hook 90 of the latch member 42 passing through the opening 39 in the oven door 26. As the cam 50 rotates due to activation of the motor 44, the latch member 42 moves to its second position, which is shown in dashed lines in FIG. 5 and in FIG. 8. When the latch member 42 is in this second position, the oven door 26 may not be opened because the hook 90 of the latch member 42 catches the back wall 34 of the oven door 26. Upon further rotation of the cam 50, the latch member 42 is pulled rearwardly in the direction of arrow 102 to its third position (illustrated in solid lines in FIG. 5 and in FIG. 8) in which the oven door 26 is locked and sealed. In this position, the oven door 26 is correctly sealed and seated so as to provide a tight seal for the oven cleaning process.

As best illustrated in FIG. 2, the motorized door latch assembly 40 further comprises a single switch 104 secured to the mounting plate 64 with at least one fastener 106. One type of switch which has proven satisfactory is manufactured by Toneluck and sold as part number L62BJ. Such a switch is a single pole single throw switch which is normally closed, rated at 5 Amp at 120/240 volts AC. As best seen in FIG. 8, the switch 104 has a spring loaded button 107 which is normally extended due to the spring (not shown). When the button 107 is extended, the switch 104 is closed or in a first state. When the button 107 is depressed against the force of the spring, the switch is opened or in a second state. However, any other switch may be used in accordance with this invention.

The indent 58 on the periphery 56 of the upper portion 54 of the cam 50 activates the switch 104 as it passes the switch 104 because it allows the button 107 to extend, thereby closing the switch 104. As shown in FIG. 3, wires 105 connected to the switch 104 communicate with a controller (not shown) to let the controller (not shown) know the position of the cam 50 and the position of the latch member 42.

Figure 10:
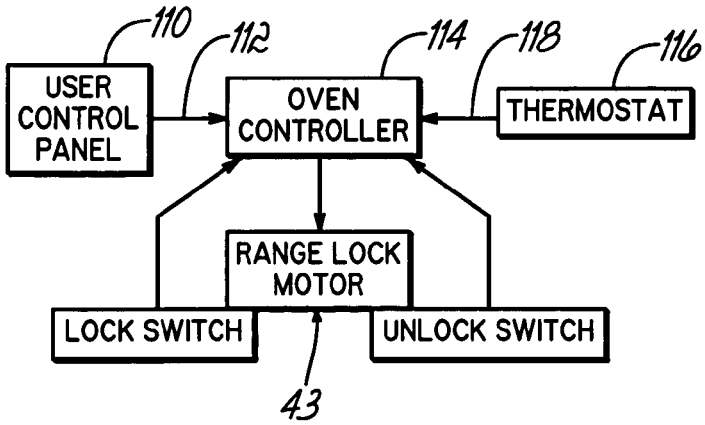
FIG. 10 is a block diagram illustrating the operation of the motorized range or oven door latch assembly.

Referring to FIG. 10, in operation, starting with the latch member 42 in the unlock position shown in FIG. 6, a user (not shown) pushes a button or some other mechanism on a user control panel 110. The user control panel 110 sends a signal along line 112 to an oven controller 114 for the cleaning cycle to begin. The oven controller 114 activates the motor assembly 43 by supplying it power (120 volts AC) for a predetermined time period. The motor assembly 43 causes the cam 50 to rotate from a first position shown in FIG. 6 to a second position shown in FIG. 8. When the cam 50 is in the first position shown in FIG. 6, the switch 104 is open due to the button 107 on the switch 104 being depressed by the ramp portion 59 of the cam 50. When the cam 50 is In the second position shown in FIG. 8, the switch 104 is closed due to the button 107 on the switch 104 extending into the indent 58 of the cam 50. When the switch 104 closes due to the extension of the button 107 of the switch 104, the controller 114 stops sending power to the motor assembly 43 so the motor assembly 43 shuts down and the cam 50 stops moving. The oven cavity 24 now reaches extremely high temperatures during the cleaning cycle in which the door latch assembly 40 causes the door 26 to be locked and sealed. See FIG. 8.

Once the temperature inside the oven cavity 24 lowers to a predetermined temperature, a thermostat 116, preferably in the oven cavity 24, sends a signal along line 118 to the oven controller 114. The oven controller 114 activates the motor assembly 43 by supplying it power (120 volts AC) for a predetermined time period. The motor assembly 43 causes the cam 50 to rotate from its second position shown in FIG. 8 to its first position shown in FIG. 6.

Upon activation of the motor 44, the cam 50 rotates, causing the latch member 42 to move from its first position shown in FIGS. 4 and 6 to its second position in which the oven door 26 is prevented from opening (See FIGS. 5 AND 7). Upon further rotation of the cam 50, the latch member 42 is pulled rearwardly from its second position to its third position in the direction of arrow 102. When the latch member 42 is in its third position the oven door 26 is in a locked and sealed position with the back wall 34 of the oven door 26 exerting pressure against a gasket 108 located between the oven door 26 and the front wall 19 of the range body.

While I have described one preferred embodiment of the present invention, persons skilled in the art will appreciate changes and modifications which may be made to the present invention without departing from the scope of the invention. Therefore, I do not intend to be limited except by the scope of the following claims.

I claim:

1. A motorized door latch assembly for locking an oven door in a closed position closing an oven cavity, said oven door being mounted on a range body and being movable between an open and said closed position, said door latch assembly comprising:

a mounting plate;

a motor secured to said mounting plate;

a cam driven by said motor, said cam having features varying over the extent of the cam;

a latch member having a hook at a first end thereof, said hook being adapted to engage said oven door, said latch member being contacted by said cam and movable between a first position in which said oven door may be opened, a second position in which said oven door may not be opened, and a third position in which said hook is moved relative to said second position to pull in said oven door toward said oven cavity; and a switch mounted to said mounting plate, said switch being movable between a first state and a second state, said switch being in said first state when said cam actuates said switch and said switch being in said second state when said cam does not actuate said switch, said switch being coupled to a controller to inform a controller of the position of the cam.

2. The motorized door latch of claim 1 wherein said switch is a single pole single throw switch.

3. The motorized door latch of claim 1 wherein said latch member has a pair of spaced upwardly extending flanges wherein rotation of said cam cause said cam to engage said flanges of said latch member and move said latch member.

4. The motorized door latch of claim 1 wherein said motor is secured to said mounting plate in a fixed position above said mounting plate.

5. The motorized door latch of claim 1 wherein said cam has a ramp and an indent on opposite sides of said cam.

6. The motorized door latch of claim 1 wherein said cam is sandwiched between said mounting plate and said motor.

7. The motorized door latch of claim 1 wherein said mounting plate has a guide in which rides a pin secured to said latch member.

8. The motorized door latch of claim 1 wherein one of said mounting plate and said latch member has a pin and the other of said mounting plate and said latch member has a guide in which said pin moves to restrict movement of said latch member.

9. The motorized door latch assembly of claim 1 wherein said hook extends through a mounting surface of said range body.

10. The motorized door latch assembly of claim 1 wherein said cam has a portion for engaging said flanges of said latch member.

11. The motorized door latch assembly of claim 1 wherein said cam has a portion for engaging and opening said switch.

12. A motorized door latch assembly for locking an oven door in a closed position, said oven door being mounted on a range body and being movable between an open and closed position, said door latch assembly comprising:

a mounting plate supportable by said range body above an oven cavity;

a motor secured to said mounting plate above said mounting plate;

a cam driven by the motor;

a single pole single throw switch mounted to said mounting plate, said switch being opened and closed by said cam and coupled to a controller to inform a controller of the position of the cam; and a latch member sandwiched between said cam and said mounting plate, said latch member having a hook at an outer end and being movable by rotation of said cam between a first position in which said oven door may be opened and a second position in which said hook of said latch member engages said oven door preventing said oven door from opening, wherein one of said mounting plate and said latch member has a pin and the other of said mounting plate and said latch member has a guide in which said pin moves to restrict movement of said latch member.

13. The motorized door latch assembly of claim 12 wherein said latch member has a pair of spaced, parallel flanges, wherein upon rotation of said cam by said motor, a portion of said cam contacts said flanges of said latch member, moving said latch member between said first and second positions.

14. The motorized door latch assembly of claim 12 wherein said latch member may be moved from said second position to a third position upon further rotation of said cam.

15. The motorized door latch assembly of claim 12 wherein said mounting plate has upwardly extending mounting tabs to which said motor is mounted.

16. A motorized door latch assembly for locking an oven door in a closed position so as to close an oven cavity for purposes of cleaning said oven cavity, said oven door being mounted on a range body, said door latch assembly comprising:

a mounting plate supportable by said range body above said oven cavity;

a motor mounted to said mounting plate;

a cam rotatably driven by said motor;

a latch member located between said cam and said mounting plate, said latch member having a hook at one end for engaging said oven door, wherein upon rotation of said cam a portion of said cam contacts said latch member, moving said latch member between a second position in which said hook of said latch member engages said oven door preventing said oven door from opening and a first position in which said oven door may be opened; and only one switch mounted to said mounting plate and actuated by said cam, the switch being operatively coupled to a controller.

17. The motorized door latch assembly of claim 16 wherein said latch member may be moved from said second position to a third position upon further rotation of said cam.

18. The motorized door latch of claim 16 wherein said latch member has a pair of spaced upwardly extending flanges wherein rotation of said cam causes said cam to engage said flanges of said latch member and move said latch member.

19. A motorized door latch assembly for locking an oven door in a closed position, said oven door being mounted on a range body and being movable between an open and closed position, said door latch assembly comprising:

a mounting plate supportable by said range body above an oven cavity;

a motor secured to said mounting plate above said mounting plate;

a cam driven by the motor;

a single pole single throw switch mounted to said mounting plate, said switch being opened and closed by said cam and coupled to a controller to inform a controller of the position of the cam; and a latch member sandwiched between said cam and said mounting plate, said latch member having a hook at an outer end and being movable by rotation of said cam between a first position in which said oven door may be opened and a second position in which said hook of said latch member engages said oven door preventing said oven door from opening, wherein said mounting plate has upwardly extending mounting tabs to which said motor is mounted.

* * * * *

UNITED STATES PATENT AND TRADEMARK OFFICE

CERTIFICATE OF CORRECTION

PATENT NO. : 7,156,428 B2
APPLICATION NO. : 10/901754
DATED : January 2, 2007
INVENTOR(S) : Donald E. Smith It is certified that error appears in the above-identified patent and that said Letters Patent is hereby corrected as shown below:

Column 3

Line 20, change “an” to --a --.

Column 4

Line 52, after “secured”, insert --to--.

Column 6

Line 38, change “In” to --in--.

Line 59, change “AND” to --and--.

Column 7

Line 36, change “cause” to --causes--.

Signed and Sealed this

Twelfth Day of June, 2007

JON W. DUDAS
*Director of the United States Patent and Trademark Office*